US011555165B2

(12) United States Patent
Salas et al.

(10) Patent No.: US 11,555,165 B2
(45) Date of Patent: Jan. 17, 2023

(54) SOLID CLEANER WITH BENZALKONIUM CHLORIDE, PEG-8, AND GUAR

(71) Applicant: Henkel AG & Co. KGaA, Duesseldorf (DE)

(72) Inventors: Juan Salas, Mesa, AZ (US); Jesus Macias, Scottsdale, AZ (US); Janice L. Fuls, Fountain Hills, AZ (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 15/827,283

(22) Filed: Nov. 30, 2017

(65) Prior Publication Data

US 2019/0161709 A1 May 30, 2019

(51) Int. Cl.

| | |
|---|---|
| ***C11D 1/62*** | (2006.01) |
| ***C11D 3/48*** | (2006.01) |
| ***C11D 1/04*** | (2006.01) |
| ***C11D 17/00*** | (2006.01) |
| ***C11D 3/22*** | (2006.01) |
| ***C11D 9/00*** | (2006.01) |
| ***C11D 3/39*** | (2006.01) |
| ***C11D 10/04*** | (2006.01) |
| ***C11D 3/37*** | (2006.01) |
| ***C11D 1/65*** | (2006.01) |

(52) U.S. Cl.

CPC ..... *C11D 3/48* (2013.01); *C11D 1/04* (2013.01); *C11D 1/65* (2013.01); *C11D 3/222* (2013.01); *C11D 3/3707* (2013.01); *C11D 3/3927* (2013.01); *C11D 9/005* (2013.01); *C11D 10/047* (2013.01); *C11D 17/0065* (2013.01); *C11D 1/62* (2013.01)

(58) Field of Classification Search

CPC .. C11D 1/04; C11D 1/126; C11D 1/37; C11D 1/62; C11D 1/65; C11D 3/2079; C11D 3/48; C11D 17/0047

See application file for complete search history.

(56) References Cited

U.S. PATENT DOCUMENTS

| | | | | |
|---|---|---|---|---|
| 5,366,665 | A * | 11/1994 | Cho | C07C 305/06 558/32 |
| 5,653,970 | A * | 8/1997 | Vermeer | A61Q 19/00 424/70.24 |
| 6,838,420 | B2 * | 1/2005 | Sachdev | C11D 3/046 510/141 |
| 7,045,491 | B2 * | 5/2006 | Hourigan | C11D 3/2065 510/141 |
| 2004/0043913 | A1 * | 3/2004 | Demson | C11D 17/0095 510/147 |
| 2007/0212323 | A1 * | 9/2007 | Polonka | C11D 10/04 424/70.22 |
| 2014/0024573 | A1 * | 1/2014 | Agarkhed | C11D 9/26 510/394 |
| 2014/0378363 | A1 * | 12/2014 | Thiessies | C11D 3/126 510/151 |
| 2017/0002297 | A1 * | 1/2017 | Klug | C11D 3/3472 |
| 2018/0153177 | A1 * | 6/2018 | Modak | A01N 31/08 |

* cited by examiner

*Primary Examiner* — Charles I Boyer
(74) *Attorney, Agent, or Firm* — James J. Cummings

(57) ABSTRACT

A solid cleaning composition, the composition including: one or more anionic surfactants, wherein the one or more anionic surfactants constitute 40 wt. % to 90 wt. % of the composition; a cationic biocide, wherein the cationic biocide constitute 0.0001 wt. % to 2 wt. % of the composition; and one or more humectants; wherein the one or more humectants constitute 0.03 wt. % to 35 wt. % of the compositions, the cationic biocide retaining its biocidal activity as demonstrated by a reduction of at least 1.0 log 10 in a standard hand wash test.

6 Claims, 1 Drawing Sheet

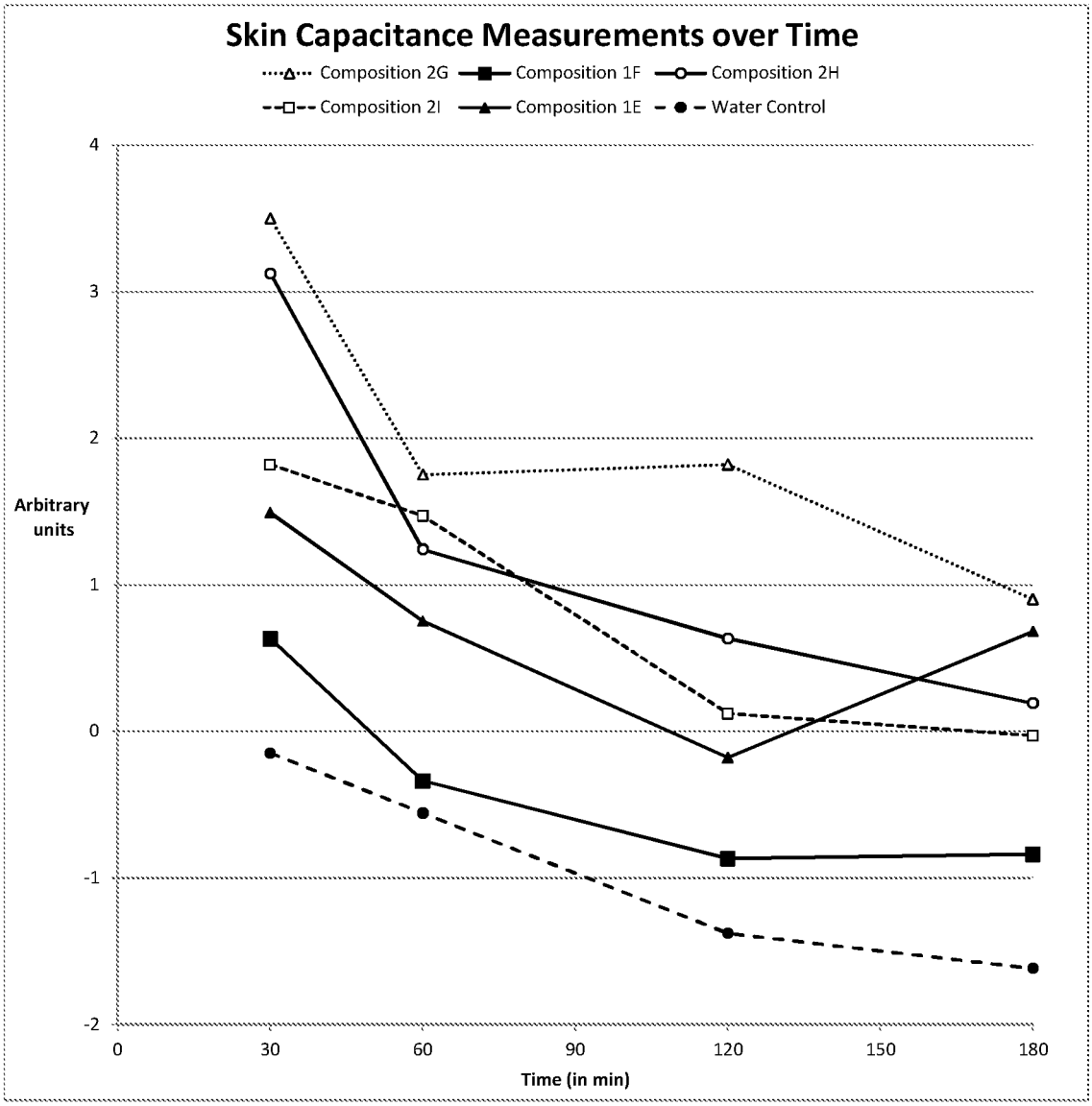
Skin Capacitance Measurements over Time
Composition 2G
Composition 1F
Composition 2H
Composition 2I
Composition 1E
Water Control
Arbitrary units
4
3
2
1
0
-1
-2
0
30
60
90
120
150
180
Time (in min)

SOLID CLEANER WITH BENZALKONIUM CHLORIDE, PEG-8, AND GUAR

BACKGROUND

Soaps and synthetic detergents may be used as cleaning compositions in the form of solid bars. Such cleaning compositions may be used to washing human skin, including removing hydrophobic contaminants. Surfactants, including soaps and synthetic detergents, increase the ability of aqueous solutions to carry hydrophobic materials. Surfactants have a hydrophilic domain and a hydrophobic domain. Surfactants orient themselves on the boundary between hydrophobic material and the water environment. This reduces the free energy of the hydrophobic material and increases the carrying capacity of hydrophobic material in the aqueous solution.

BRIEF DESCRIPTION OF THE DRAWINGS

FIG. 1 shows the results of a lower leg controlled application test (LCAT) for a variety of compositions as assessed with a corneometer.

DETAILED DESCRIPTION

Cleaning bars are assessed using a variety of parameters. These may include: cleaning, dry feeling, tight feeling, oil removal, conditioning, anti-viral activity, material cost, production cost, stability, fragrance or lack thereof, anti-bacterial activity, etc. As in any development activity, balancing the different design parameters to produce a desirable product is a challenge, in part because optimization of one parameter may result in lack of optimization of other parameters.

There is ongoing demand for products with strong anti-bacterial and/or anti-virial properties, which may also be referred to as biocidal activity. These products see use in homes, offices, and many businesses, including medical facilities. The use of soaps to reduce bacteria and virus fragments, especially on hands, is part of medical practice. However, the compositions of many anti-bacterial and anti-viral products makes them hard on skin, resulting in dryness, chapping, cracking, and other problems which discourage use and/or produce other health hazards.

Accordingly, it is desirable to have a stable solid composition which combines anti-bacterial and anti-viral properties with skin conditioning. The challenge is that skin conditioning components have a tendency to reduce the effectiveness of the anti-bacterial and/or anti-viral component(s) of the soap. Further, there are not effective predictive models for when combinations will retain their functionality. Instead, much of the work in this area is experimental in nature.

Investigation into forming a solid composition which retains functionality of a quaternary amine biocide and/or a cationic biocide has been challenging. Soaps include anionic surfactants, including both synthetic and natural soaps. Quaternary amines are cationic species due to the quaternary amine with its positive charge. Under a variety of conditions, free energy of the system is minimized by coupling the positive and negative charges producing a complex with low solubility and little biocidal activity.

Similarly, when looking to add conditioning agents, the inventors initially theorized that conditioners with structures similar to the quaternary amines would allow the quaternary amines to retain their biocidal activity. This proved to be incorrect, although the reason and mechanism explaining why the presence of cationic conditioners sometimes inhibits the functionality of the cationic biocides is not clear. However, further investigation uncovered other conditioning agents that were compatible with both the anionic surfactants (soaps) and the quaternary amines (biocides). These discoveries allowed composition of a shelf stable, solid, anionic surfactant-based soap with both biocidal and conditioning properties.

All numbers used in this specification and the associated claims should be treated as having the implied precision unless a precision is otherwise noted. The implied precision of a number is half the value of the least significant digit. Thus, the implied precision of 10 is +/−5 units and would be understood to cover a range of 15 to 5 units, while the implied precision of 11 is +/−0.5 units and would be understood to include a range from 10.5 to 11.5 unless otherwise noted. Recited ranges and values should be understood to cover the entire range of the implied precision unless otherwise recited. If needed, scientific notation using the symbol "E" for exponent of a power of ten will be used to assure the desired specificity. So, "5E1" indicates 50, while "5.0E1" indicates 50 where the zero is a significant digit.

As used in this specification and the associated claims, the term "unmodified" when applied to a molecule or class of molecules indicates that those molecules have not been functionalized with another functional group outside the group or groups defining the base molecule. Thus, an "unmodified" polyglycol contains only the basic ether links and the organic segments and does not have a fatty chain added, an amine, etc.

Among other examples, this specification describes a solid cleaning composition, the composition including: one or more anionic surfactants, wherein the one or more anionic surfactants constitute 40 wt. % to 90 wt. % of the composition; a cationic biocide, wherein the cationic biocide constitute 0.0001 wt. % to 2 wt. % of the composition; and one or more humectants; wherein the one or more humectants constitute 0.03 wt. % to 35 wt. % of the compositions, the cationic biocide retaining its biocidal activity as demonstrated by a reduction of at least 1.0 log 10 in a standard hand wash test.

Among other examples, this specification also describes a solid cleaning composition, the composition including: a quaternary amine biocide; one or more humectants, wherein the one or more humectants include: a polyglycol, wherein the polyglycol constitutes 0.1 wt. % to 20 wt. % of the composition; and one or more anionic surfactants, wherein the one or more anionic surfactants constitute at least 40 wt. % of the composition, wherein the composition is a solid at room temperature and pressure and wherein the composition produces at least a 1.0 log reduction in live bacteria as measured by a standard hand wash test.

This specification also describes a solid soap composition including: a cationic biocide; a humectant; at least 50 wt. % fatty acid salts; and at least 5 wt. % syndet, wherein the composition has a pH of 4 to 8, produces at least a 2.0 log 10 reduction of bacteria in ASTM E1174, and produces a moisturizing effect in an Lower Leg Controlled Application Test (LCAT) such that a mean corneometer measurement of a composition treated region drops at least two standard deviations less than the mean drop for a water control.

The effectiveness of soap in conditioning may be evaluated using a Lower Leg Controlled Application Test (LCAT). LCAT is a technique that can reliably discriminate the moisturization potential of personal cleansing and/or leave-on products used under recommended use conditions. Materials that occlude the skin and/or enhance lipids can increase skin hydration and/or increase skin barrier function. Test objective is to assess and compare the relative moisturization potential of personal cleansing products by visual and instrumental evaluations. Moisturization is demonstrated by showing benefit effects when compared to water. This procedure also allows for testing of multiple products on a given subject, increasing the statistical power of the comparison.

For the described LCAT testing, six test sites (5 cm×5 cm) are marked on the outer aspect of lower legs of each subject. Each test site is washed with the assigned test product or is washed with water as a control. Visual evaluations for dryness are taken at baseline to qualify. Instrument (Skicon & Corneometer) readings are taken for relative skin hydration at baseline, 30 minutes, 1 hour, 2 hours and 3 hours after a single wash. To generate the following results, approximately 20 women participated in the study. Subject ages were between 18-55 years of age.

A corneometer uses a dielectric measurement of the skin to calculate a water level (hydration) of the skin. Successive measurements allow monitoring of the amount of water in the skin over time. A moisturizing product is one that enhances retention of water in the skin over time. In contrast, when products without the moisturizing quality are used, the skin dries over time. The use of a water-only rinse provides a negative control representing no moisturizing. In some data sets, a commercially available product with adequate moisturizing serves as a positive control. Positive and negative controls provide baselines to validate test results for the current environmental conditions and test subject conditions.

Using LCAT a variety of compositions were tested and categorized into three groups: 1) Non-moisturizing, 2) Semi-moisturizing, and 3) Moisturizing. Group 1 included the water control and available commercial soaps and controls. Group 2 included a commercially available moisturizing bar. Group 3 included several of the optimized compositions disclosed in this specification. Each of the groups was statistically distinct from the others with a p-value of less than 0.05 using standard tools and methods. A sample size (n) of ~20 participants was used for each of the various tests.

Compositions falling in Group 1, non-moisturizing, as assessed using LCAT included: 1A) a commercially available 100% natural soap bar, 1B) a natural soap bar with 20% talc, 1C) a natural soap bar with 15% talc and 5% sodium sulfite, 1D) a high glycerin natural soap bar (commercially available product), 1E) a 70% synthetic detergent (syndet)/30% natural soap combination bar, and 1F a 16% glycerin and 17% moisture content natural soap bar. Group 1 compositions did not exhibit at least two standard deviations increase in moisture retention in the stratum corneum compared with the water control. Accordingly, Group 1 compositions, while they may be more moisturizing than the water control, were characterized as non-moisturizing to distinguish them from compositions in groups 2 and 3 which significantly increased moisture retention ($p<0.05$) in the stratum corneum compared with the water control.

Compositions falling in Group 2, semi-moisturizing, as assessed using LCAT, included: 2G) a syndet with moisturizing cream (commercially available product), 2H) a 85% syndet/15% natural soap combination bar, and 21) a 50% syndet/50% natural soap combination bar. We note the composition of 1E is between 2H and 21, indicating non-linearity in the behavior of the compositions. Group 2 compositions were characterized by exhibiting significantly less water loss in the stratum corneum as assessed with a corneometer compared with a water control. Significance was defined as having a p-value of less than 0.05. As a first pass, this may be considered to be equivalent to having two standard deviations (based on pooled variance) between the mean test value and the mean control. The variation may be calculated using standard statistical analysis methods.

Samples falling in Group 3, moisturizing, as assessed using LCAT included: 3J) a 90% syndet/10% natural soap bar with Polyquaternium-10 and BAC; 3K) a 90% syndet/10% natural soap bar with Guar and BAC, 3L) a 90% syndet/10% soap bar with Polyquaternium-7 and BAC; 3M) an 85% syndet/15% soap bar with Polyquaternium-10 and BAC; 3N) an 85% syndet/15% soap bar with Guar and BAC, 3O) an 85% syndet/15% vegetable soap bar with Guar and BAC; 3P) a low-pH (~pH 5) 100% syndet bar with betaine, Guar, and BAC; and 3Q) a low-pH (~pH 5) 100% syndet bar with sodium lauroyl methyl isethionate, Guar, and BAC. Group 3 compositions were characterized by exhibiting significantly less water loss in the stratum corneum as assessed with a corneometer compared with the water control. Significance was defined as having a p-value of less than 0.05. As a first pass, this may be considered to be equivalent to having two standard deviations (based on pooled variance) between the mean test value and the mean control. The variation may be calculated using standard tools and methods. In most cases, sufficient samples (n of ~20) were run to obtain p-values well below 0.001.

FIG. 1 shows an example of measurements from a corneometer when conducting an LCAT study. The trend toward decreasing water content of the stratum corneum over time is evident. This reflects the drying of the skin over time. The positive control (commercial moisturizing bar 2G) shows significantly better performance compared with the water control and the shown group 1 compositions.

Soaps include fatty acid salts, which may be made from tallow, other animal fats, and/or plant oils. Soaps may be produced by reacting a base, such as sodium hydroxide, with triglycerides, fats, and/or oils to produce fatty acid salts. Fatty acid salts of $C_{12}$ to $C_{20}$ may be used to produce bar soaps. Some suitable fatty acids include, but are not limited to: lauric acid, myristic acid, palmitic acid, stearic acid, oleic acid, linoleic acid, and/or linolenic acid. Mixtures of fatty acid salts with different alkyl groups may be used. This is especially common when a plant or animal source is used to provide the base material to form the fatty acid salts. Combining multiple distributions or multiple species of fatty acid salts allows tuning and adjustment of properties of the cleaning bar.

Syndet, short for synthetic detergent, refers to surfactants producing soap-like surfactant behavior without saponification of fats and oils. These include a variety of materials, including, but not limited to: sodium cocoyl isethionate, sulfosuccinates, alpha olefin sulfonates, alkyl glyceryl ether sulfonate, sodium cocoyl monoglyceride sulfate, and/or betaines.

Guar refers to guar gum, a polysaccharide of galactose and mannose. Other polysaccharides may be used in addition to and/or instead of guar gum. Example polysaccharides include: xanthan gum, cornstarch, locus bean gum, carrageenan, cassia tora, gum Arabic, gum acacia, and natural and/or modified cellulose and/or methyl-cellulose.

The formulation contains humectants. In one example, the humectants comprise 0.03 wt. % to 35 wt. The humectants may comprise 0.3 to 8 wt. % of the formulation. Humectants may include polysaccharides, fatty acids, and/or polyols of five carbons or less (such as glycerol, and/or 1,2 propandiol).

Humectants contain a hydrophilic domain to stabilize and/or retain water. A mixture of humectants may be used, for example, glycerol may be used to modify adjust the stiffness of the solid cleaning composition and a guar may be used to provide viscosity when the soap is dissolved into water during use, modifying the film properties of the cleaning composition-water mixture.

Fatty acids may also be included in the bar cleaning composition. The fatty alcohols may be unmodified. The fatty alcohols may include a polyglycol domain. Fatty acids have a hydrophilic domain in the carboxyl group and a fatty chain. Fatty acids, as used herein, refers to C6 to C22 monocarboxylic acids. Fatty acids may have a terminal carboxyl group. In other cases, the carboxyl group is located somewhere else on the fatty chain, for example, toward the center of the fatty chain. The fatty chain may be saturated, unsaturated, and/or polyunsaturated. The fatty chain may be linear or branched. If present, fatty acids may constitute from 0.001 to 8 wt. % of the formulation.

Polyquaternium-7 is a copolymer of acrylamide and diallyldimethylammonium chloride. Like all polyquaternium surfactants, polyquaternium-7 is a polymer with multiple cationic centers, e.g., quaternary amines.

Polyquaternium-10 is quaternized hydroxyethyl cellulose. Like all polyquaternium surfactants, polyquaternium-10 is a polymer with multiple cationic centers, e.g., quaternary amines.

Benzalkonium chloride (BAC) is a cationic surfactant with anti-microbial/biocidal properties. Benzethonium chloride (BZC) is another cationic surfactant with similar properties. BZC may be substituted for BAC and vice versa. Cetrimonium chloride (CC) and cetrimonium bromide (CTAB) are additional quaternary ammonium compounds with biocidal activity. The cationic biocide may be a quaternary alkyl-ammonium compound. For example, the cationic biocide may have four alkyl substitutions, and an associate halide anion. The four akyl substitutions may include one longer linear chain, for example, $C_8$ to $C_{22}$, and three smaller alkyl groups, for example $C_1$ to $C_3$. While the examples above are the more widely used quaternary amine biocides, other variations with similar properties may provide benefits in compatibility and stability. Bisbiguanides, e.g., chlorhexidine and polymeric biguanides, e.g., polyhexamethylene biguanide may also be used as cationic biocides in the present compositions.

In some examples, the cationic biocide is used with a zinc ion source. For example, zinc may be provided as a complexed species such as zinc picolinate, zinc citrate, zinc acetate, zinc glycerate, zinc gluconate, and/or zinc monomethionine. Zinc may be provided in other forms for example, ZnCl, ZnI, ZnO, etc. In one example, the zinc is provided both as an ionic species and as a nanoparticle. Suitable nanoparticles may have a longest mean axis length of 30 nm, with averages from 20 to 60 nm enhancing antibacterial activity. Zinc compounds may be present from 0.00001 to 1.8 wt. % of the formulation. In one example, an ionic zinc compound constitutes 0.02 to 0.8 wt. % of the formulation.

Talc (e.g., $H_2Mg_3(SiO_3)_4$ or $Mg_3Si_4O_{10}(OH)_2$) and sodium sulfite ($Na_2SO_3$) are cleaning composition ingredients available from commercial suppliers. Talc may be used to provide abrasive/exfoliating properties. Talc may be used with loading up to 30 wt. % of the cleaning composition. Talc may be 12 to 18 wt. % of the composition. Sodium sulfite may provide pH modification and/or chelation of soils.

The cleaning composition may include fragrance, colorants, and/or other bar cleaning composition components. In an example, these components are present up to 2 wt. % of the composition. These components may be up to 0.8 wt. % of the composition.

While many of the above compositions fall into group 3, moisturizing, not all of them retained the functionality of the quaternary amine biocide. Perhaps surprisingly, among the moisturizing components, the polyquaternium, which are also cationic, frequently inhibited biocidal activity. In contrast, the compositions with a polysaccharide based moisturizing component retained functionality and moisturizing when mixed with a soap base.

A time kill study was conducted using *Serratia marcescens*. Samples of the bacteria were exposed to a various solutions for 30 seconds. The killing power of the exposure was reported in log 10 format. A syndet bar slurry with 0.10% BAC had >4.72 log 10 reduction in living bacteria after 30 seconds. A syndet bar slurry with 0.10% BAC and guar had a similar result, i.e., >4.72 log 10 reduction in living bacteria after 30 seconds. In contrast, a syndet bar slurry with 0.10% BAC with polyquaternium-10 had a reduction of only 1.77 log 10 after 30 seconds. Results in this test classify up to 1 log 10 reduction as no activity; 1 to 2 log 10 reduction as moderate activity; and above 2 log 10 reduction as high activity.

The time kill study suggests that different moisturizing components interact differently with the efficacy of the quaternary amine biocide. Unexpectedly, the polyquaternium-10, which has similar cationic domains, seemed to inhibit the effectiveness of the quaternary amine biocide in the presence of syndet. In contrast, the polysaccharide did not appear to inhibit the activity of the quaternary amine biocide.

The Health Care Personnel Hand Wash (ASTM E1174) is a standardized method that measures the reduction of *Serratia marcescens* following a hand washing episode using prototype compositions. Briefly, the hands are inoculated with $1.0\times10^9$ cfu/hand of *Serratia marcscens*. Bacterial concentrations may be expressed in colony forming units (cfu). Hands are then placed in sterile bags and 75 mL of stripping solution is added. The hands are massaged for 1 minute. A sample is taken and plated using standard plate methods to determine the number of bacteria on the hands. This is considered the baseline. The hands are then inoculated again followed by a hand washing treatment. Hands are washed for thirty seconds and then rinsed for thirty seconds. The bacteria recovery step is repeated. The difference in the bacteria found after treatment compared to baseline is calculated and reported as the log 10 reduction. Generally speaking, reductions of less than 1 order of magnitude (1.0 log 10) is considered low and/or inactive. Reductions of 1 to 2 orders of magnitude are considered indicative of biocidal activity but below acceptable levels to characterize as effective. Results of greater than 2 orders of magnitude reduction (2.0 log 10) are considered evidence of effectiveness. The FDA in the 1994 tentative final monograph expects a minimum 2.0 log reduction following a single wash.

When assessed with using ASTM E1174, composition 3J produced a reduction of 1.88 log 10. Composition 3K produced a reduction of 1.91 log 10. A control produced a reduction of 2.31 log 10. A second study using 3R) 90% syndet/10% soap with 0.25% guar, 0.13% BAC, 0.25% $ZnSO_4$, 1.5% cetrimonium chloride (CC) produced a reduction of 1.81 log 10 (vs. a 2.48 for the control). A composition 3S) of 90% Syndet/10% soap with 0.25% guar, 0.20% BAC, 0.25% $ZnSO_4$, 1.5% CC produced a reduction of 1.91 log 10. Thus, even though additional know biocides, zinc and cetrimonium chloride were added, the biocidal activity did not significantly change.

Adjusting the syndet/soap ratio and adding a polyglycol, like polyethylene glycol (PEG), as a moisturizing component produced a bump in effectiveness. Composition 3T) an 85% Syndet/15% soap with guar, 0.13% BAC, 1% polyethylene glycol (PEG-8) produced a 2.05 log 10 reduction (compared with 2.49 for the control). Based on initial results, a larger study (E1174) of composition 3T was repeated with a mean reduction of 2.27 log 10, this established that the 3T composition was capable of producing both the desired moisturizing and retaining the biocidal activity of the BAC in a solid cleaning bar composition.

Polyethylene glycol (PEG), also called polyethylene oxide (EO, PEO), is a polyglycol with $C_2H_4$ units connected by ether bridges. Polypropylene glycol (PPG) is a similar material with $C_3H_6$ units. Polyglycols are widely used due to their ability to tune the properties by modifying the length of the polymer, their established safety profile, and their ability to modify viscosity and/or interact with water in a composition. Polyglycols may constitute from 0.01 wt. % to 5 wt. % in a cleaning bar. In an example, the polyglycol is polyethylene glycol and constitutes from 0.5 wt. % to 1.5 wt. % of the composition. The PEG may be, for example, PEG-8 (MW 400). The polyglycol may be a mixture of two or more weights and/or types of polyglycol. For example, a cleaning composition may include both PEG-8 and PEG-12. A cleaning composition may include both PEG-12 and PPG-10.

It will be appreciated that, within the principles described by this specification, a vast number of variations exist. It should also be appreciated that the examples described are only examples, and are not intended to limit the scope, applicability, or construction of the claims in any way.

What is claimed is:

1. A solid cleaning composition, the composition comprising:

A) a cationic biocide consisting of 0.0001 wt. % to 2 wt. % of benzalkonium chloride (BAC);

B) at least 40 wt. % anionic surfactants comprising:

i) a synthetic detergent;

ii) a soap mixture comprising at least two different C12-C20 fatty acid salts, and a C6-C22 monocarboxylic fatty acid;

C) a polysaccharide moisturizing component comprising guar: and

D) 0.5-5% of PEG-8; wherein:

a) the composition does not contain a polyquaternium;

b) the composition is a solid at room temperature and pressure; and c) the BAC retains its biocidal activity as demonstrated by a reduction of at least 2.0 log 10 in a standard hand wash test.

2. The composition of claim 1 wherein the synthetic detergent is an isethionate.

3. The composition of claim 1 wherein at least one of the C12 to C20 fatty acid salts comprises sodium oleate.

4. The composition of claim 1, wherein the C6-C22 monocarboxylic fatty acid comprises stearic acid.

5. The composition of claim 1 wherein the C6 to C22 monocarboxylic fatty acid comprises stearic acid and lauric acid.

6. The composition of claim 1 wherein the C12 to C20 fatty acid salt is selected from the group consisting of salts of lauric acid, myristic acid, palmitic acid, stearic acid, oleic acid, linoleic acid, linolenic acid, and mixtures thereof.

* * * * *